US008006419B2

(12) United States Patent
Kabalka

(10) Patent No.: US 8,006,419 B2
(45) Date of Patent: Aug. 30, 2011

(54) WINDOW DISPLAY MATERIAL HOLDER FOR VEHICLE WINDOWS

(76) Inventor: George Walter Kabalka, Knoxville, TN (US)

( * ) Notice: Subject to any disclaimer, the term of this patent is extended or adjusted under 35 U.S.C. 154(b) by 19 days.

(21) Appl. No.: 12/590,687

(22) Filed: Nov. 12, 2009

(65) Prior Publication Data

US 2011/0107634 A1 May 12, 2011

(51) Int. Cl.
*G09F 21/04* (2006.01)

(52) U.S. Cl. ..... 40/593; 224/482; 224/277; 211/89.01

(58) Field of Classification Search ..... 40/593, 40/777, 794, 796; 224/277, 482; 211/89.01
See application file for complete search history.

(56) References Cited

U.S. PATENT DOCUMENTS

| | | | | |
|---|---|---|---|---|
| 1,350,302 | A * | 8/1920 | Eldridge | 40/584 |
| 1,738,425 | A * | 12/1929 | Evans | 224/277 |
| 3,541,714 | A * | 11/1970 | Bruck, Jr. | 40/791 |
| 4,058,221 | A * | 11/1977 | Elkins et al. | 211/106.01 |
| 4,154,383 | A * | 5/1979 | Honatzis | 224/556 |
| 4,576,320 | A | 3/1986 | Mead | |
| 4,889,268 | A | 12/1989 | Shubeck | |
| 5,000,410 | A | 3/1991 | Beavers | |
| 5,010,670 | A | 4/1991 | Minervini | |
| 5,031,808 | A * | 7/1991 | Dolenc | 224/482 |
| 5,170,917 | A | 12/1992 | Tourigny | |
| 5,195,668 | A | 3/1993 | Kunes et al. | |
| 5,390,437 | A | 2/1995 | Pearson | |
| 5,628,133 | A | 5/1997 | Cooper | |
| 5,690,307 | A | 11/1997 | Joyce | |
| 5,960,572 | A | 10/1999 | DeVito | |
| 5,971,242 | A | 10/1999 | Schuerman | |
| 6,098,860 | A | 8/2000 | Phillips | |
| 6,298,590 | B1 * | 10/2001 | Levinson | 40/591 |
| 6,530,661 | B1 | 3/2003 | Vorbis | |
| 6,546,657 | B2 | 4/2003 | Gray | |
| 6,718,667 | B2 | 4/2004 | Applebee | |
| 7,007,418 | B2 * | 3/2006 | Anderson et al. | 40/591 |
| 7,344,177 | B1 | 3/2008 | Glenn | |
| 7,360,338 | B2 | 4/2008 | Repp et al. | |
| 7,370,983 | B2 | 5/2008 | DeWind et al. | |
| 7,591,096 | B2 | 9/2009 | Krinke et al. | |
| 7,624,524 | B2 * | 12/2009 | Mullins | 40/593 |
| 2002/0117522 | A1 | 8/2002 | Murphy | |
| 2002/0139024 | A1 | 10/2002 | Applebee | |
| 2003/0066224 | A1 | 4/2003 | Sumner, III et al. | |
| 2005/0005488 | A1 | 1/2005 | Burke | |
| 2006/0087804 | A1 | 4/2006 | Tsukamoto | |
| 2007/0107287 | A1 | 5/2007 | Huang | |
| 2008/0017767 | A1 | 1/2008 | Sheffield et al. | |
| 2008/0212215 | A1 | 9/2008 | Schofield et al. | |
| 2009/0159772 | A1 | 6/2009 | Noble | |

* cited by examiner

*Primary Examiner* — Joanne Silbermann
*Assistant Examiner* — Shin Kim

(57) ABSTRACT

A window display materials holder for holding window display material for viewing from the outside of a vehicle. The holder includes a flexibly-rigid body having an insertion edge and a gripping edge. The insertion edge is designed to be inserted between a window and trim adjacent thereto. The gripping edge has gripping structure. The flexibly-rigid body is substantially coplanar to the window when the insertion edge is inserted between the window and the trim adjacent thereto.

5 Claims, 5 Drawing Sheets

WINDOW DISPLAY MATERIAL HOLDER FOR VEHICLE WINDOWS

BACKGROUND OF INVENTION

This invention relates, generally, to a unique vehicle window attachment or holder and, more specifically, to a unique attachment or holder for vehicle windows for keeping window display materials in place and visible from the outside of the vehicle.

Due to safety and security regulations in place throughout the world, most vehicles (defined herein as including automobiles, trucks, boats, planes, and any other type of vehicle that has at least one framed or "trimmed" window) are required to display appropriate identification, licenses, or permits to access garages, parking lots, apartment building premises, airport waiting areas, handicap zones, public parks, campgrounds, etc. In addition, public events often require some type of "ticket" or "pass" that must be displayed such that it is visible from outside the vehicle. In many instances, flyers (such as "For Sale" signs and other advertisements) need to be visible from outside the vehicle while being kept inside, secure from the elements. These placards, tickets, passes, flyers, and other small items (hereinafter referred to as "window display materials") include any type of informational, practical, ornamental, inspirational, or commercial message or design. Window display materials can be displayed in a vehicle window and (1) are substantially flat, (2) are relatively lightweight, and (3) are relatively small.

Some window display materials are attached to windows using adhesives. Users often dislike using adhesives (e.g. all or part of the window display materials are "stickers") because of the permanence and/or mess they create. Adhesives, if they are semi-permanent or non-permanent, often do not remain attached to the window and fall off. This can result in costly citations, towing fees, etc., or at least inconvenience for the vehicle operator as he attempts to resolve the fees and citations.

Window display materials are sometimes presented as "hang tags" or similar appropriately labeled paper and/or plastic documents. Although hang tags that are designed to hang from mirrors are convenient, in many instances more than one is required. In addition, modern vehicles are often equipped with rear-view mirrors that are part of a communication system that, due to their bulk, have no place from which to hang a "hang tag." As a consequence, many window display materials are simply placed on the dashboard or windowsill of the vehicle, where they are often missed by inspectors outside the vehicle, resulting in costly citations, towing fees, etc., or at least inconvenience for the vehicle operator as he attempts to resolve the fees and citations.

U.S. Pat. No. 5,960,572, issued to DeVito on Oct. 5, 1999, discloses a Toll Pass Holder. The DeVito toll pass holder has a housing having an open top compartment with a large open front window, so as to receive an electronic toll pass inserted therein. The DeVito device has structure for temporarily retaining the housing to an interior surface of a windshield in a motor vehicle. The large open front window in the housing faces the interior surface of the windshield, so that the electronic toll pass can operate therefrom. The DeVito holder is designed to encapsulate toll pass cards and, therefore, the size and thickness of the toll pass is restricted to the carrying capacity of the holder. Larger items such as "Handicap Hangtags" would not fit into the device. The DeVito holder is designed to attach to various surfaces of the vehicle using suction cups, which limit the carrying capacity of the device and the length of time the device will remain attached.

U.S. Pat. No. 5,010,670, issued to Minervini on Apr. 30, 1991, discloses an Automobile Window Display Apparatus. The Minervini display apparatus includes a display panel for carrying a message. The panel is pivotally mounted to the rear window molding for movement between a retracted position and a vertical display position in which the message is visible through the rear window. A cord attached to the lower edge of the display panel extends forwardly and is hooked onto the rear view mirror mount. This allows the driver to unhook the cord for rearward movement under the weight of the panel as the panel drops to its display position. The Minervini display apparatus appears to be limited to placement in the rear window of a vehicle.

U.S. Pat. No. 4,889,268, issued to Shubeck on Dec. 26, 1989, discloses an Automobile Window Card Holder. The Shubeck card display device for automobile windows includes a strip of material overlapped upon itself to form a series of pockets for holding cards or other advertising material. The top end of the strip is reversely turned to form a retaining flange for locking the strip on the top edge of an automobile window pane when closed. In the preferred embodiment, the strip extends beyond the flange perpendicular to the back of the strip, thereby forming a handle for carrying and positioning the card holder. The Shubeck card display device appears to be limited to placement in side windows of a vehicle.

BRIEF SUMMARY OF THE INVENTION

Preferred embodiments of the window display materials holder solve the problems of the prior art by providing a convenient, secure, and removable (and re-positional) holder means to attach a wide variety of items, including placards, tickets, passes, flyers, and other small items (window display materials) to the inside of the windows of a vehicle so that the window display materials are readily visible from outside the vehicle. Preferred embodiments of the window display materials holder may be installed on the edges (sides, top, and bottom) of any window in the vehicle (exact locations will vary with individual vehicles). Preferred embodiments of the window display materials holder may be removed and repositioned at will and readily placed in alternate positions within the vehicle.

An easily installed window display materials holder for holding window display material (placards, tickets, passes, flyers, and other small items) for viewing from the outside of a vehicle. The holder includes a flexibly-rigid body having an insertion edge and a gripping edge. The insertion edge is designed to be inserted between a window and trim adjacent thereto. The gripping edge has gripping structure. The flexibly-rigid body is substantially coplanar to the window when the insertion edge is inserted between the window and the trim adjacent thereto. Preferred embodiments of the window display materials holder may be installed on the edges (sides, top, and bottom) of any window in the vehicle.

None of the prior art devices provide the benefits of the versatile, readily moved preferred embodiments of the window display materials holder to keep window display materials in place and visible from the outside of the vehicle. None of the prior art devices attach to the window of a motor vehicle in a manner equivalent to the preferred embodiments of the window display materials holder.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings, which are incorporated in and constitute a part of this specification, illustrate various exemplary embodiments.

DETAILED DESCRIPTION OF THE INVENTION

Figure 1:
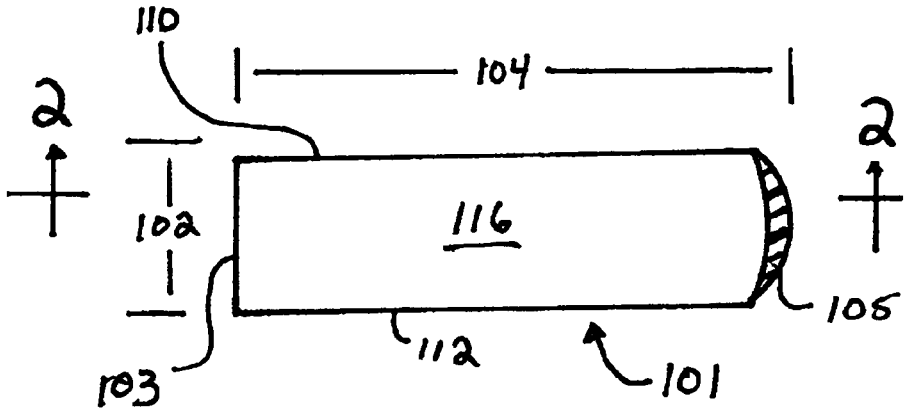
FIG. 1 is a top perspective view of a first preferred exemplary window display materials holder of the present invention.

Referring to FIGS. 1-5, a window display materials holder (which includes the window display materials holder 101 of FIGS. 1 and 2, the window display materials holder 101' of FIGS. 3 and 5, and the window display materials holder 101" of FIGS. 4 and 5, all of which are referred to generally as window display materials holder 101) is designed to be inserted between the vehicle window (e.g. the front window 120 (windshield), a side window 122, or the rear window 124) and the window trim (e.g. the dashboard trim 130, the side trim 132, the roof trim 134, or the door trim 136) surrounding the window. As shown in FIGS. 6-9, the window display material 100 to be held or supported can be inserted between the holder 101 and the window so that the window display material 100 is visible from outside the vehicle. Preferred embodiments of the window display materials holder 101 may be installed on the edges (sides, top, and bottom) of most, if not all, trimmed windows inside the vehicle (exact locations will vary with individual vehicles). Alternative embodiments could involve installation on the exterior window trim for installation on the exterior of the vehicle.

Preferred embodiments of the window display materials holder 101 may be removed and repositioned at will and readily placed in alternate positions between the window(s) and the trim. Using preferred embodiments of the window display materials holder 101, the window display material 100 can be easily removed and replaced. When a window display material 100 is in position between the window and the window display materials holder 101, it is held or supported therebetween because the flexibly-rigid body of the window display materials holder 101 is substantially coplanar (albeit sometimes on a curve) to the window and so the window display material is lightly gripped (with a minimal amount of pressure) therebetween.

Before describing the exemplary embodiments of the window display materials holder 101 and the figures depicting them, some of the terminology should be clarified. Please note that the terms and phrases may have additional definitions and/or examples throughout the specification. Where otherwise not specifically defined, words, phrases, and acronyms are given their ordinary meaning in the art. Exemplary embodiments may be better understood with reference to the drawings, but these embodiments are not intended to be of a limiting nature. In most instances, the same reference numbers will be used throughout the drawings and description in this document to refer to the same or like parts. The term "window display material 100" is defined as an item that can be displayed in a vehicle window. Window display materials 100 (1) are substantially flat (which is meant to include material that, for example, is textured or has small bumps, cut-outs, holes, and/or ridges), (2) are relatively lightweight (which is meant to include materials that are less than three (3) ounces), and (3) are relatively small (which is meant to include window display materials that cover less than 10% of the area of the vehicle window and in most cases are less than 4"×8"). Examples of window display materials are placards (handicap, parking, etc.), tickets, passes, flyers, and other small items that may include any type of informational, practical, ornamental, inspirational, or commercial message or design.

The terms "interior window trim," "interior trim," "window trim," and/or "trim" are defined as the structures surrounding a vehicle window and include, for example, the dashboard trim 130, the side trim 132, the roof trim 134, the door trim 136, or the rear window deck 138. In embodiments in which the window display materials holder 101 is used in the interior of the car, the "trim" is the "interior window trim." Alternative embodiments could use exterior window trim if the window display materials holder 101 is to be positioned on the exterior of the vehicle. The term "coplanar" is used to describe the relationship between the positioned window display materials holder 101 and its adjacent window in that the window display materials holder 101 lies substantially adjacent to the window even if the window is curved.

The exemplary window display materials holders 101 (including the embodiments shown in FIGS. 3 and 4) are shown as a body having four edges: an insertion edge 103, a gripping edge 105, a top edge 110 connecting the top corner of the insertion edge 103 to the top corner of the gripping edge 105, and a bottom edge 112 connecting the bottom corner of the insertion edge 103 to the bottom corner of the gripping edge 105. A lower surface 114 spans between the edges and is designed to be adjacent to the vehicle window. An upper surface 116 is distal from the lower surface 114.

Figure 3:
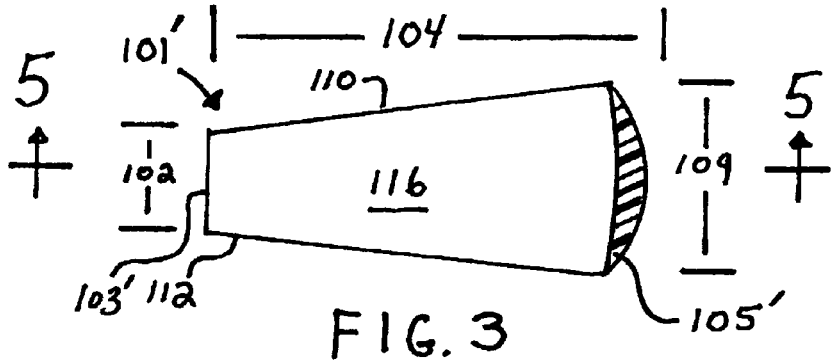
FIG. 3 is a top perspective view of a second preferred exemplary window display materials holder of the present invention.
Figure 4:
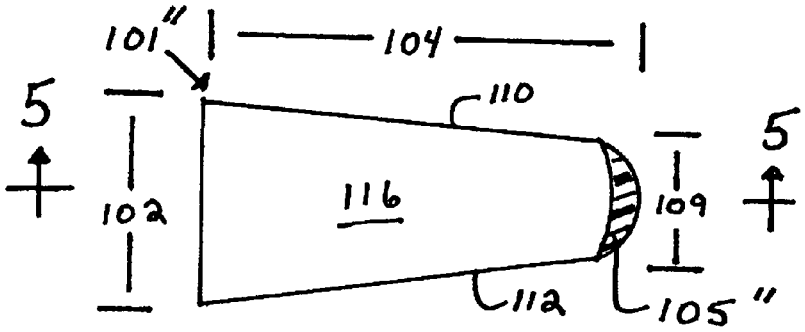
FIG. 4 is a top perspective view of a third preferred exemplary window display materials holder of the present invention.

Although one preferred basic shape (from the top looking down, as shown in FIGS. 1, 3, and 4) is substantially rectangular (FIG. 1), alternative preferred embodiments may have alternative shapes, including but not limited to those shown in FIG. 3 (in which the width 102 of the insertion edge 103 is smaller than the width 109 of the gripping edge 105) and FIG. 4 (in which the width 102 of the insertion edge 103 is larger than the width 109 of the gripping edge 105). It should be noted that alternative shapes (which could include but are not limited to elliptical, round, trapezoidal, triangular, and square shapes) and sizes may be used.

Figure 10:
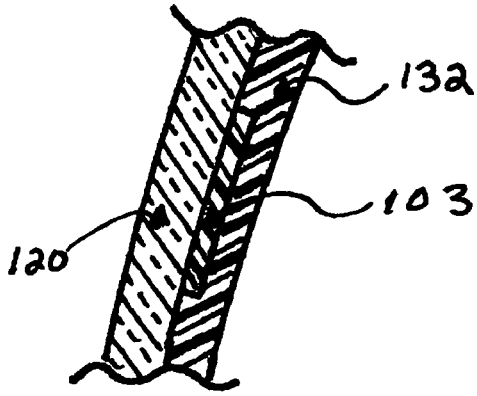
FIG. 10 is a cross-sectional view of an exemplary insertion edge inserted between a vehicle window and trim therearound.
Figure 11:
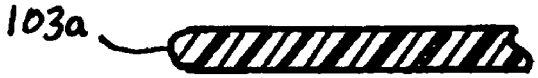
FIG. 11 is an enlarged cross-sectional lengthwise view of an exemplary rounded insertion edge.
Figure 12:
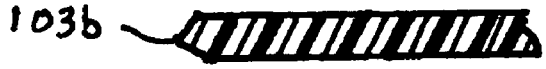
FIG. 12 is an enlarged cross-sectional lengthwise view of an exemplary pointed insertion edge.
Figure 13:
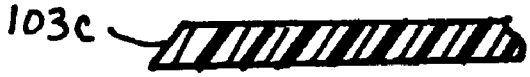
FIG. 13 is an enlarged cross-sectional lengthwise view of an exemplary wedge-shaped insertion edge.
Figure 14:
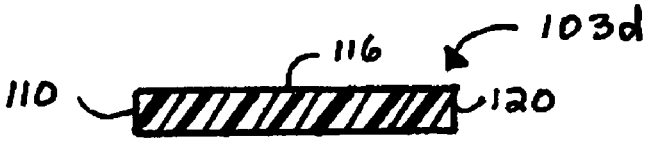
FIG. 14 is an enlarged cross-sectional widthwise view of an exemplary insertion edge with squared top and bottom edges.
Figure 15:
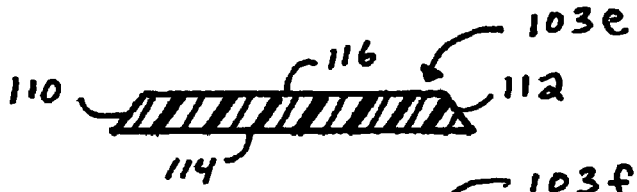
FIG. 15 is an enlarged cross-sectional widthwise view of an exemplary insertion edge with angled top and bottom edges.
Figure 16:
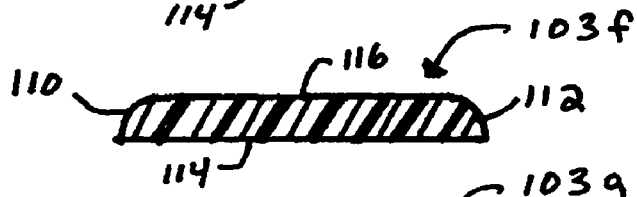
FIG. 16 is an enlarged cross-sectional widthwise view of an exemplary insertion edge with arced top and bottom edges.

The insertion edge 103 of an exemplary window display materials holder 101 is designed to be inserted into the gap between the window and the trim therearound. The insertion edge 103 is the edge that is inserted between window and trim therearound as shown in FIG. 10. Although FIG. 10 shows an exaggerated deflection (bend) of the trim 132 with the insertion edge 103 inserted between the window 120 and the trim 132, in practice the deflection may be minimal or nonexistent. Although shown in FIGS. 2 and 5 as being a squared insertion edge, the insertion edge 103 may have alternative preferred shapes including, but not limited to, a rounded insertion edge 103*a* (FIG. 11), a pointed insertion edge 103*b* (FIG. 12), or a wedge-shaped insertion edge 103*c* (FIG. 13). It should be noted that the pointed insertion edge 103*b* and the wedge-shaped insertion edge 103*c* may be "sharp" or may be slightly rounded to prevent scratching, cutting, and/or tearing of the window and/or trim.

Figure 17:
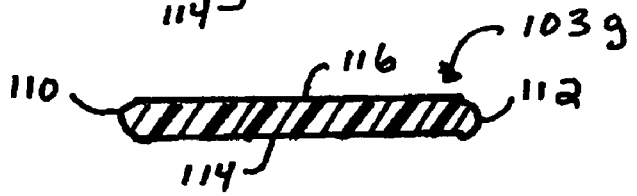
FIG. 17 is an enlarged cross-sectional widthwise view of an exemplary insertion edge with rounded top and bottom edges.

FIGS. 14-17 show exemplary insertion edges 103*d*-103*g* in which the top edge 110 and the bottom edge 112 may be, for example, squared (FIG. 14), angled (FIG. 15), arced (FIG. 16), or rounded (FIG. 17). It should be noted that the top edge 110 and the bottom edge 112 may be slightly rounded to prevent scratching, cutting, and/or tearing of the window and/or trim.

Figure 2:
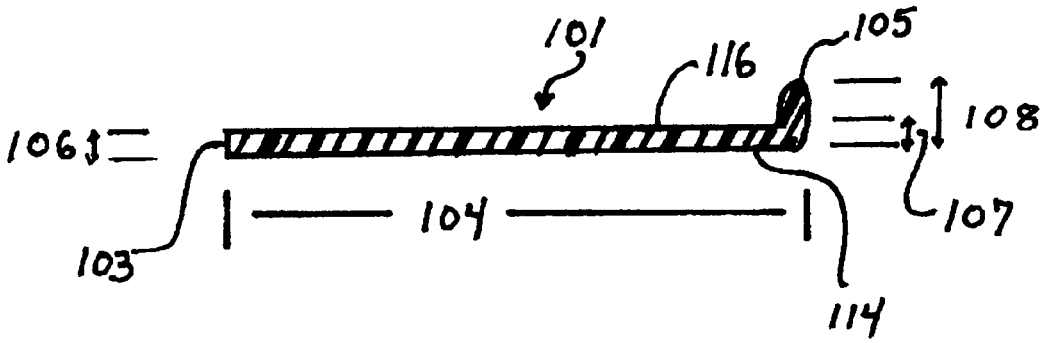
FIG. 2 is a transverse sectional view of the window display materials holder taken through the center of the holder shown in FIG. 1, along the line 2-2.
Figure 5:
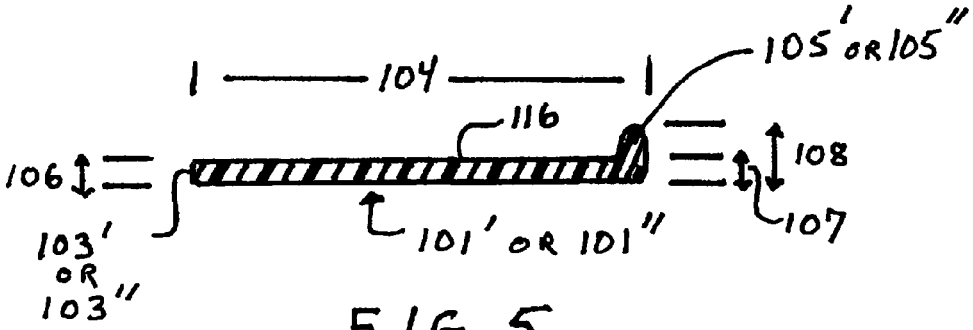
FIG. 5 is a transverse sectional view of window display materials holders shown in FIG. 3 and FIG. 4 at line 5-5.
Figure 18:
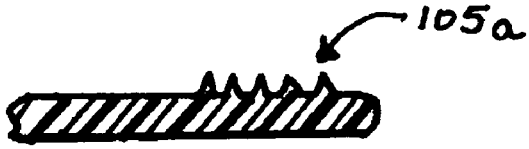
FIG. 18 is an enlarged cross-sectional lengthwise view of an exemplary textured gripping edge with a rounded edge distal from the insertion edge.
Figure 19:
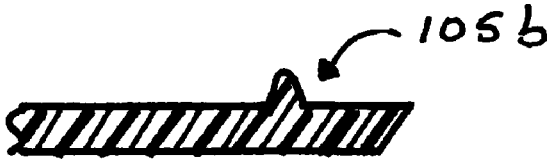
FIG. 19 is an enlarged cross-sectional lengthwise view of an exemplary ridged gripping edge with an angled edge distal from the insertion edge.
Figure 20:
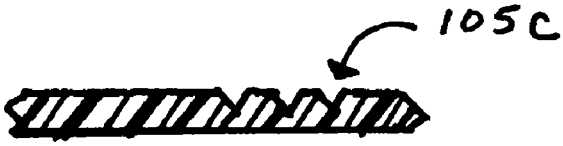
FIG. 20 is an enlarged cross-sectional lengthwise view of an exemplary grooved gripping edge with a pointed edge distal from the insertion edge.

Exemplary preferred embodiments of the gripping edge 105 (which can be thought of as the "outer edge" or the edge remote from the insertion edge 103) are shown in FIGS. 1-5. The gripping edge 105 is preferably designed to be grasped and/or pushed and may include structure suitable for enhanced gripping. For example, as shown in FIGS. 2 and 5, one preferred gripping edge 105 has an upward curve. Alternative preferred embodiments of the gripping edge 105 may be a textured (defined as any combination of ridges and grooves that assist in gripping) gripping edge 105*a* (FIG. 18), a ridged (defined as at least one raised surface) gripping edge 105*b* (FIG. 19), or a grooved (defined as at least one indent or cut in the surface) gripping edge 105*c* (FIG. 20). The gripping edge 105 may be used to insert (by pushing) the holder 101 into the gap between the window and the trim therearound. The gripping edge 105 may also be used to remove (by pulling) the holder 101 from the gap between the window and the trim therearound. It should be noted that in some embodiments the gripping edge 105 may have structure thereon that increases the rigidity of the gripping edge 105. For example, the upward-curved gripping edge 105 in FIGS. 1-5 and the ridged gripping edge 105*b* of FIG. 19 would tend to increase the rigidity of the gripping edge 105.

Preferred embodiments of the window display materials holder 101 are flexibly-rigid. "Flexibly-rigid" can be defined as able to hold its shape but, with pressure, would flex. If the pressure were removed, the material would return to its original shape. In other words, devices constructed from the material basically hold their shape, but may bend under pressure. When the window display materials holder 101 is inserted between a window and the trim, a certain amount of pressure may cause the flexibly-rigid window display materials holder 101 to bend so that it holds a curve substantially coplanar with the curve of (lies substantially adjacent to) the window. This would help to hold a window display material 100 towards the window. Also, a bend held in one direction (e.g. longitudinally) would strengthen the rigidity in the other direction.

Preferred embodiments of the window display materials holder 101 are transparent or clear such that the window display materials 100 can be seen on both sides. On the other hand, even non-transparent materials would allow the window display materials 100 to be seen from the outside of the vehicle.

It should be noted that one preferred window display materials holder 101 is constructed from a transparent (or clear) and flexibly-rigid plastic (suitable materials include, but are not limited to, acrylic, polycarbonate, polyester, polystyrene, and polyvinyl chloride polymeric materials). Alternative preferred materials include, but are not limited to, alternative plastics, metals, woods, carbon fiber, or various composite materials. The use of other materials shall be considered within the scope of the invention.

Referring to FIGS. 1-2, an exemplary preferred window display materials holder 101 is a single piece of flexibly-rigid, transparent, plastic body with a longitudinal length 104 of 2.00 inches to 4.00 inches, a latitudinal width 102 of 1.00 inch to 2.00 inches, and a depth (from the upper surface 116 to the lower surface 114) 106, 107 of 0.05 inches to 0.30 inches. It is understood that the specifications may be increased or decreased depending upon the usage envisioned for the window display materials holder 101.

Referring to FIGS. 3-5, these alternative preferred embodiments of the window display materials holders 101', 101" are made from a single piece of flexibly-rigid, transparent plastic with a longitudinal length 104 of 2.00 inches to 5.00 inches, a latitudinal width 102, 109 of 1.00 inch to 3.00 inches, and a depth (from the upper surface 116 to the lower surface 114) 106, 107 of 0.10 inches to 0.30 inches. It is understood that the specifications may be increased or decreased depending upon the usage envisioned for the window display materials holder 101.

FIGS. 3 and 4 illustrate alternative shapes for the window display materials holder 101', 101". These examples are not meant to be exclusive, or to limit the design to those shown. It will be understood that various modifications, substitutions, and changes in the form and detail of the devices illustrated can be made by those skilled in the art without departing in any way from the spirit of the present invention.

Referring to FIGS. 2 and 5, the dimensions of the insertion edge depth 106 and the gripping edge depth 107 may be identical or they may differ. It is envisioned that minimizing depth 106 may result in simpler insertion of the window display materials holder 101 between the vehicle interior window and the trim therearound.

Referring to FIGS. 1-5, the height 108 of gripping edge 105 of the window display materials holder 101 may vary from the depth 106, 107, ranging from a totally flat holder 101 to one in which the height of the curved edge is approximately three times that of depth 106, 107. The gripping edge 105 used to push the holder between the window and the trim therearound may exhibit curvature (as illustrated) or it may be constructed with no curvature (a straight edge) and be parallel to the insertion edge 103.

Figure 6:
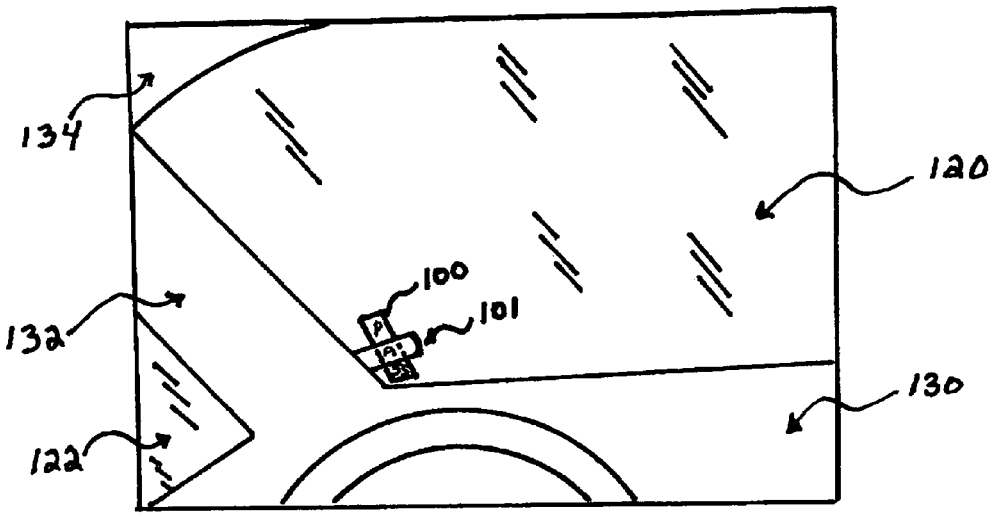
FIG. 6 is an enlarged front elevational view taken from the interior of the vehicle of a portion of a vehicle including a front window (windshield) showing an exemplary preferred placement of an exemplary window display materials holder installed between the front window and the interior window trim adjacent thereto and holding an exemplary window display material (shown as a pass).

FIG. 6 shows one preferred point of insertion of an exemplary window display materials holder 101 in the lower left portion of the front window 120. As shown, the window display materials holder 101 is installed between the front window 120 and the interior window trim (shown as side trim 132) adjacent thereto. The window display materials holder 101 holds an exemplary window display material 100 (shown as a pass). Exact placement may be dependent on the window trim in the vehicle.

Figure 7:
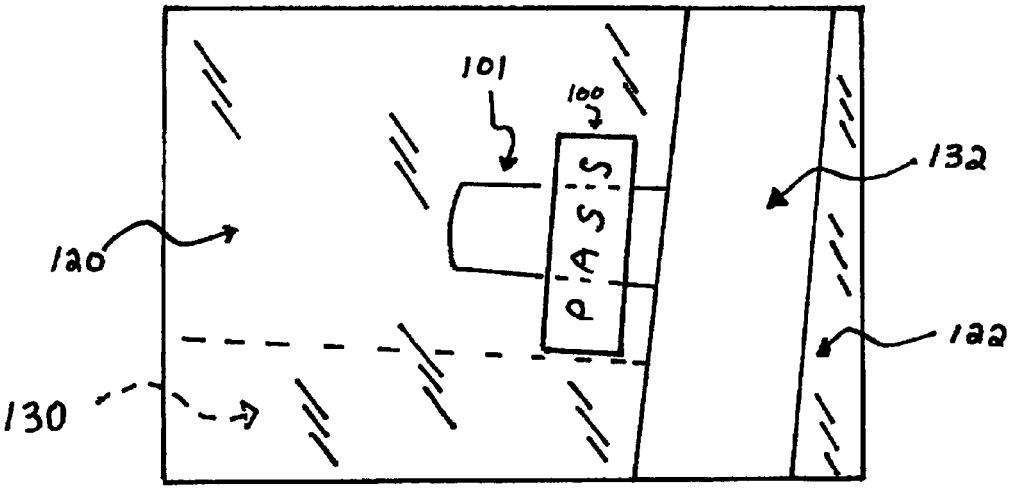
FIG. 7 is an enlarged front elevational view window taken from the exterior of the vehicle of a portion of a vehicle including a front window (windshield) and showing an exemplary window display material (shown as a pass) inserted between the window display materials holder and the interior of the window.

FIG. 7 shows a view from the outside of a vehicle. In this figure, the window display material 100 (shown as a pass) is inserted between the window display materials holder 101 and the interior (inside of the vehicle) of the front window 120. The window display material 100 is inserted as shown in FIG. 6 between the front window 120 and the interior window trim (shown as side trim 132) adjacent thereto.

Figure 8:
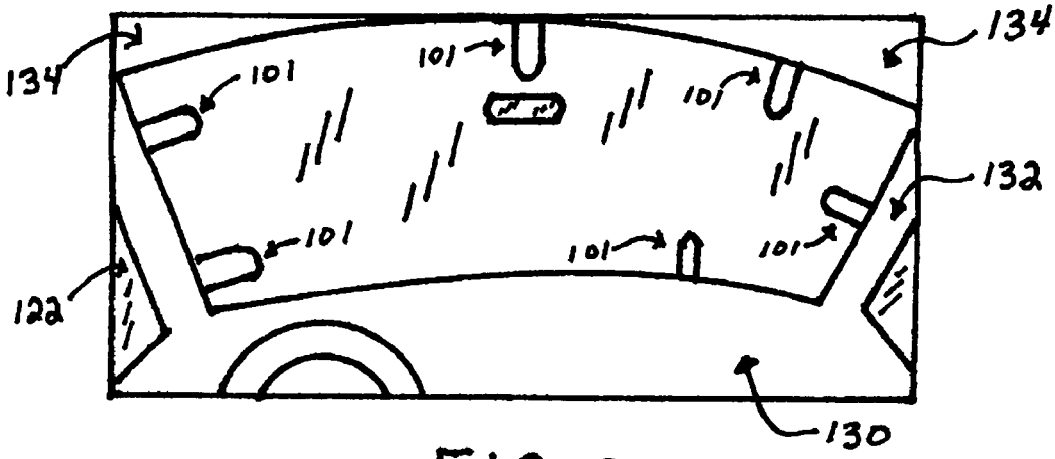
FIG. 8 is a front elevational view of a portion taken from the interior of the vehicle of a vehicle including a front window (windshield) illustrating possible placements of window display materials holder for easy exterior viewing of window display materials (not shown).
Figure 9:
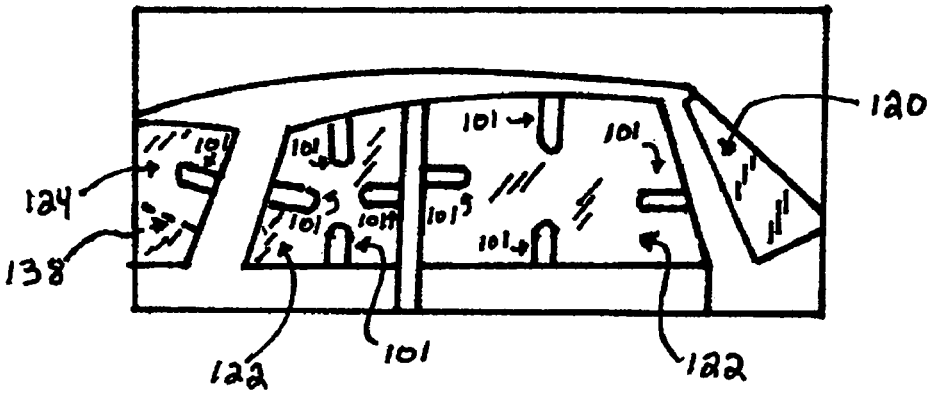
FIG. 9 is a front elevational view taken from the exterior of the vehicle of a portion of a vehicle including a side window illustrating representative placements of the window display materials holder for easy exterior viewing of window display materials (not shown).

FIGS. 8 and 9 show various potential points of insertion of the window display materials holder 101 in the vehicle's front window 120 and side windows 122. It is understood that placement in the rear window 124 would be accomplished in substantially the same manner as that in the front window 120. Exact placement positions will be dependent on the vehicle's window trim. It is also understood that placement of the window display materials holder 101 may occur on the outside of the vehicle's side windows.

It should be noted that multiple window display materials holders 101 may be used to hold larger window display materials 100.

It should be noted that relative terms (e.g. interior and exterior) are meant to help in the understanding of the technology and are not meant to limit the scope of the invention. Similarly, the term "top" is meant to be relative to the term "bottom" and the term "upper" is meant to be relative to the term "lower." As the orientation of the body of the window display materials holder 101 is changed, the "top" and "bottom" edges could be, for example, on the sides or reversed (the "bottom" being on the "top" and the "top" being on the "bottom"). As the orientation of the body of the window display materials holder 101 is changed, the "upper" and "lower" surfaces could be, for example, on the sides or reversed (the "lower" being on the "upper" and the "upper" being on the "lower"). It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the term "includes" means "comprises" (e.g. a device that includes or comprises A and B contains A and B but optionally may contain C or additional components other than A and B). It should be noted that, unless otherwise specified, the singular forms "a," "an," and "the" refer to one or more than one, unless the context clearly dictates otherwise.

It is to be understood that the inventions, examples, and embodiments described herein are not limited to particularly exemplified materials, methods, and/or structures. Further, all publications, patents, and patent applications cited herein, whether supra or infra, are hereby incorporated by reference in their entirety.

The terms and expressions that have been employed in the foregoing specification are used as terms of description and not of limitation, and are not intended to exclude equivalents of the features shown and described. This application is intended to cover any adaptations or variations of the present invention. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention which, as a matter of language, might be said to fall therebetween.

What is claimed is:

1. A window display materials holder that is completely secured on one side of a vehicle window for holding a window display material for viewing from the outside of a vehicle, said vehicle having at least one window, each window having closely fitted trim at least partially surrounding said window, said holder comprising:

(a) a flexibly-rigid body having an insertion edge for inserting the holder between the window and the closely fitted trim surrounding the window and a gripping edge for grasping the body of the display holder while inserting it between the closely fitted window trim and the window;

(b) said insertion edge designed to be is inserted between a window and the closely fitted trim adjacent thereto such that the rigid structure of the holder is held in place by the pressure exerted by the trim pushing against the window; and (c) said gripping edge having gripping structure, said gripping edge being distal from said insertion edge is grasped while pushing the insertion edge into the small space between the closely fitted trim and the window adjacent to the trim;

(d) wherein said flexibly-rigid body being both stiff and strong does not bend and is substantially coplanar to the window when said insertion edge is inserted between the window and the closely fitted trim adjacent thereto such that the pressure normally exerted by the trim upon the window acts to hold the flexibly-rigid structure of the holder in place.

2. The holder of claim 1, said insertion edge which is pushed into the narrow space between the closely fitted trim and the adjacent window is selected from a group consisting of:

(a) a squared insertion edge;

(b) a rounded insertion edge;

(c) a pointed insertion edge; and (d) a wedge-shaped insertion edge.

3. The holder of claim 1, said gripping edge which is grasped while pushing the distal insertion edge into the narrow space between the closely fitted window trim and the adjacent window is selected from a group consisting of:

(a) an upwardly curved gripping edge;
(b) a textured gripping edge;
(c) a ridged gripping edge; and
(d) a grooved gripping edge.

4. The holder of claim 1, said flexibly-rigid body being transparent.

5. The holder of claim 1, wherein said strong, stiff, flexibly-rigid body being substantially coplanar to the window and positioned entirely on one side of the window (front/back/side windows at any top/bottom/side location having closely fitted window trim) is suitable for supporting a window display material positioned between said flexibly-rigid body and the window.

* * * * *